United States Patent [19]

Fuller et al.

[11] Patent Number: 5,044,554

[45] Date of Patent: Sep. 3, 1991

[54] HYDRAULIC JUMP WATER DISPLAY

[76] Inventors: Mark W. Fuller, 10711 Bluffside Dr., #101, Studio City, Calif. 91604; Alan S. Robinson, 5344 C N. Peak Rd., El Monte, Calif. 91732

[21] Appl. No.: 514,422

[22] Filed: Apr. 25, 1990

[51] Int. Cl.[5] ..... B05B 17/08

[52] U.S. Cl. ..... 239/17; 239/20

[58] Field of Search ..... 239/17-18, 239/20, 22-23; 40/406-407, 427, 439, 362, 584

[56] References Cited

U.S. PATENT DOCUMENTS 4,715,136 12/1987 Fuller et al. ..... 239/17

4,747,538 5/1988 Dunn et al. ..... 239/20

*Primary Examiner*—Andres Kashnikow

*Assistant Examiner*—Lesley D. Morris

*Attorney, Agent, or Firm*—Blakely, Sokoloff, Taylor & Zafman

[57] ABSTRACT

Hydraulic jump water displays and methods for creating the same to provide attractive and varying displays are disclosed. In accordance with the method, water under pressure is expelled in the form of a thin sheet across a substantially flat, approximately horizontal surface bounded at the opposite end thereof by a very small dam, preferably water pool therebelow. By varying the water pressure of the source, a hydraulic jump may be created in the water backing up from the dam, which hydraulic jump may be caused to move in either direction, with the water flowing over the dam, ranging in quantity from essentially none to a substantially surge depending upon the direction or motion of the hydraulic jump. Appropriate control of the water supply pressure will generate relatively non-repetitive displays. Various embodiments are disclosed.

19 Claims, 2 Drawing Sheets

HYDRAULIC JUMP WATER DISPLAY

BRIEF SUMMARY OF THE INVENTION

Hydraulic jump water displays and methods for creating the same to provide attractive and varying displays are disclosed. In accordance with the method, water under pressure is expelled in the form of a thin sheet across a substantially flat, approximately horizontal surface bounded at the opposite end thereof by a very small dam, preferably water pool therebelow. By varying the water pressure of the source, a hydraulic jump may be created in the water backing up from the dam, which hydraulic jump may be caused to move in either direction, with the water flowing over the dam, ranging in quantity from essentially none to a substantially surge depending upon the direction or motion of the hydraulic jump. Appropriate control of the water supply pressure will generate relatively non-repetitive displays. Various embodiments are disclosed.

DETAILED DESCRIPTION OF THE INVENTION

Figure 1:
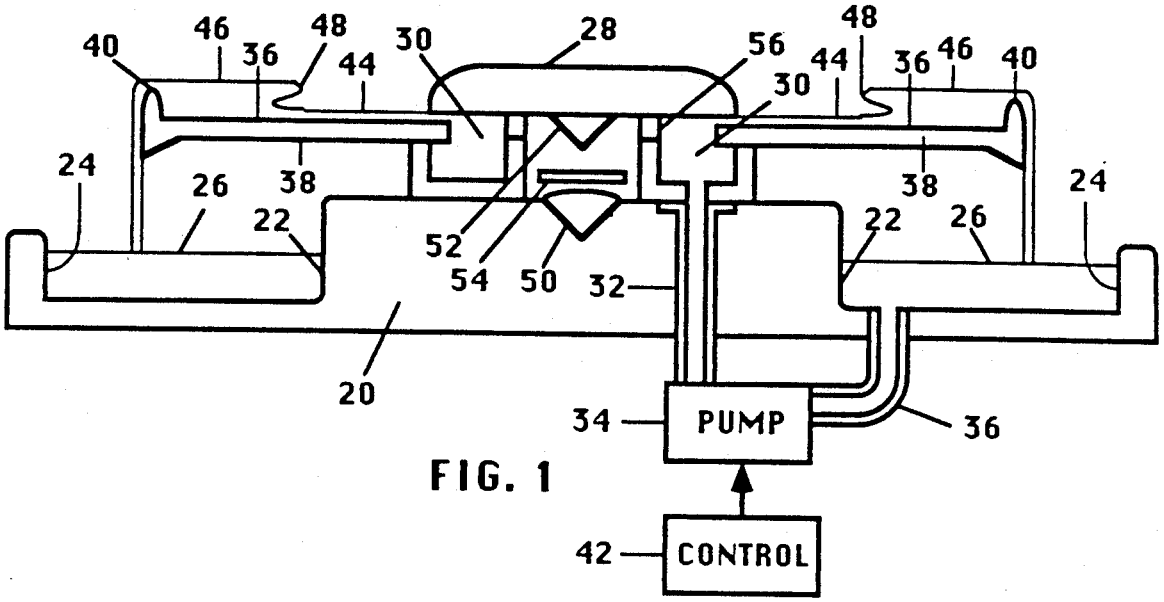
FIG. 1 is a schematic cross section of certain representative embodiments of the present invention.

First referring to FIG. 1, a schematic cross section (not to scale) of a typical water display in accordance with the present invention may be seen. As shown therein, such a display will typically have some form of foundation or structure 20 defining, among other things, walls 22 and 24 for retaining one or more pools of water 26. As shall subsequently be seen, the cross section shown may schematically represent the cross section of various forms of structures, such as by way of example, a generally circular structure with a circular pool 26, an arc of such a structure spanning less than 360°, a cross section of a generally elongate structure, etc.

The top of the structure shown in FIG. 1 is some form of decorative top or cap 28 covering a manifold region 30 supplied with water under pressure through line 32 from a pump 34 in turn supplied with water through line 36 from the pool or pools 26. A generally flat, and in the embodiment shown in FIG. 1, horizontal surface 36 is defined in this embodiment by cantilevered member 38 having adjacent the outer periphery thereof a small upward extending dam like protrusion 40. Member 38 extends somewhat under the cap 28 to define a relatively small slit-like opening therebetween through which the water under pressure in manifold 30 may be expelled outward over surface 36 in a thin sheet at a velocity dependent upon the pressure in the manifold. For purposes of specificity, in one embodiment of the present invention, the slit or gap between surface 36 and the cap 28 through which water is expelled is approximately ⅛ inches, with the distance between the outer edge of cap 28 defining the slit opening and the dam 40 at the outer edge of surface 36 being approximately 8 feet. In that embodiment the damn itself is approximately 6 inches high, with the pressure of the water in the manifold region 30 ranging from almost zero to 30 psi. This creates a flow speed at the outlet of the slit of approximately 30 miles per hour for the higher operating pressure.

In operation, controller 42 controls the pump 34, and more particularly the outlet pressure thereof, so that the controller may vary the outlet pressure with time in a predetermined manner. In one embodiment the controller 42 actually controls the speed of the pump 34. However, the outlet pressure of the pump, more particularly the pressure delivered to the manifold region 30 under typical operating conditions, may be varied by other techniques, such as by way of example, controllably throttling the pump outlet. Similarly, in the preferred embodiment the controller 42 is a computer controller, allowing for the easy programming and reprogramming thereof and the inclusion of multiple pressure varying sequences to achieve different effects in the water display, though of course other types of controllers may also be used.

In operation, if the pressure in the manifold region 30 is maintained at the high end, the water emitted in the thin sheet 44 will continue at a substantial velocity all the way across surface 36, being stopped only by the dam like protrusion 40. Because of the energy in the sheet immediately adjacent to the dam, the water stopped by the dam cannot flow back against the oncoming flow, but instead builds up to spill over the dam 40 and into the pool 26 therebelow. At the other end of the extreme, if the pressure in manifold 30 is maintained at the low end, very little energy will exist in the flow of water emitted so that the same will not force any or at least much water over the dam 40, but rather the same will build up in a much thicker water mass 46. The separation region 48 between the thin water sheet 44 and the thicker, much lower energy water 46 is of the character of a wave moving toward the cap 28, much like a wave approaching a beach. Increasing the pressure in the manifold region 30 again will cause the higher energy water in thin sheet 44 to prevent the backup of the low energy water in region 46, and to actually start encouraging the same to spill over the dam 40 by establishing a hydraulic jump in region 48, and for adequate pressures in manifold region 30, forcing the hydraulic jump to move toward dam 40, ultimately, if desired, sweeping substantially all of the puddled water in region 46 over the dam. This will occur for a flow only somewhat greater than the flow in the thin sheet 44 for a moderately high pressure, up to a substantial surge for high pressure water in the manifold region 30. Thus, by control of the pressure in the manifold region 30, the position of the hydraulic jump and the motion thereof, as well as the wave motion back toward cap 28 and the water flow over dam 40, may all be controlled in a smoothly varying manner to provide an interesting and dynamic water display. In that regard, the variation in the water flow over the dam 40 is in itself an attention getting feature of the invention, as the water flow may range from very little to quite a substantial surge, creating a water flow noise ranging from very little to a substantial waterfall type sound.

If desired, lighting may be provided for the water. While the exact form of the lighting apparatus will, of course, vary depending upon the shape and structure of the water display, a lighting system is schematically shown in FIG. 1. In particular, in the schematic, a light source 50 illuminates a conical reflector 52 through some form of color wheel 54 which may be rotated to change the color of the light passing therethrough. The reflector 52 reflects the vertically oriented incoming light from the light source 50 to a substantially horizontal direction, the same passing through a space or alternatively a clear member, such as a clear plastic member 56, to illuminate the thin sheet of water being emitted from the edge thereof. This general form of "edge" lighting, coupled with an imperfectly smooth surface on the water, will tend to cause the entire thin sheet of water, and for that matter at least part of the thicker region 46, to glow with the associated colored light as a result of the repeated reflection of much of the light off of the water/air interface before finally impinging on that interface at a sufficient angle to pass outward therefrom.

Figure 2:
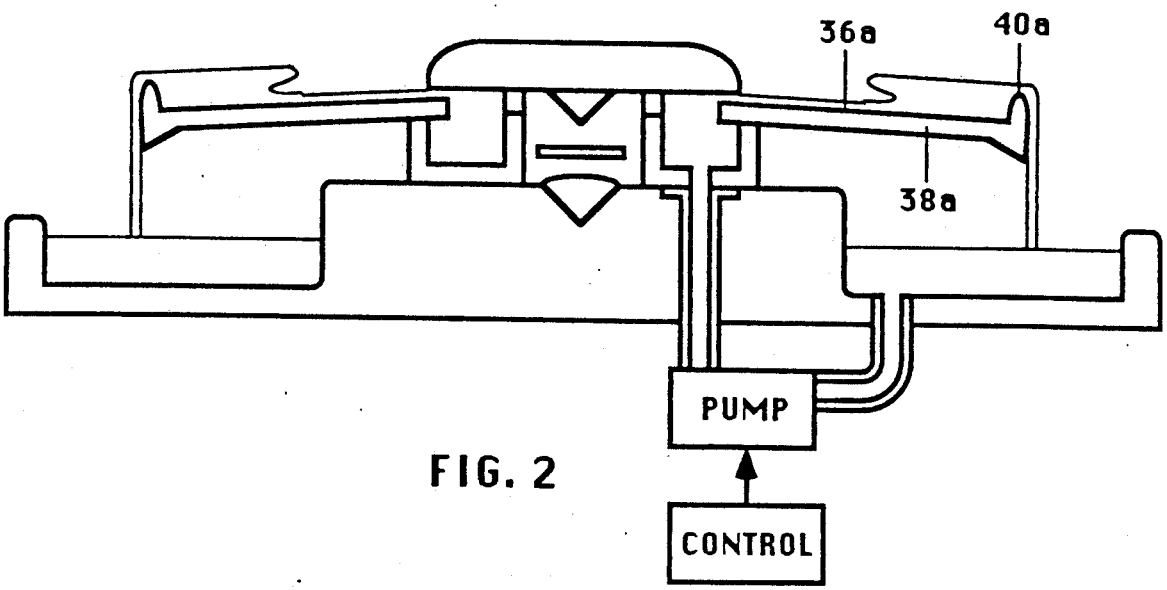
FIG. 2 is a schematic cross section of certain alternate embodiments of the present invention.

FIG. 2 is very similar to FIG. 1, differing therefrom principally by the fact that member 38*a*, and thus surface 36*a*, is inclined slightly, sloping downward toward the dam 40*a* thereon. The extent of the slope, the height of the dam, etc. are of course parameters which one can select depending upon the specific results desired, though in general, the height of the dam will normally be made to at least approximate the accumulated drop from the slope of surface 36*a*.

Figure 3:
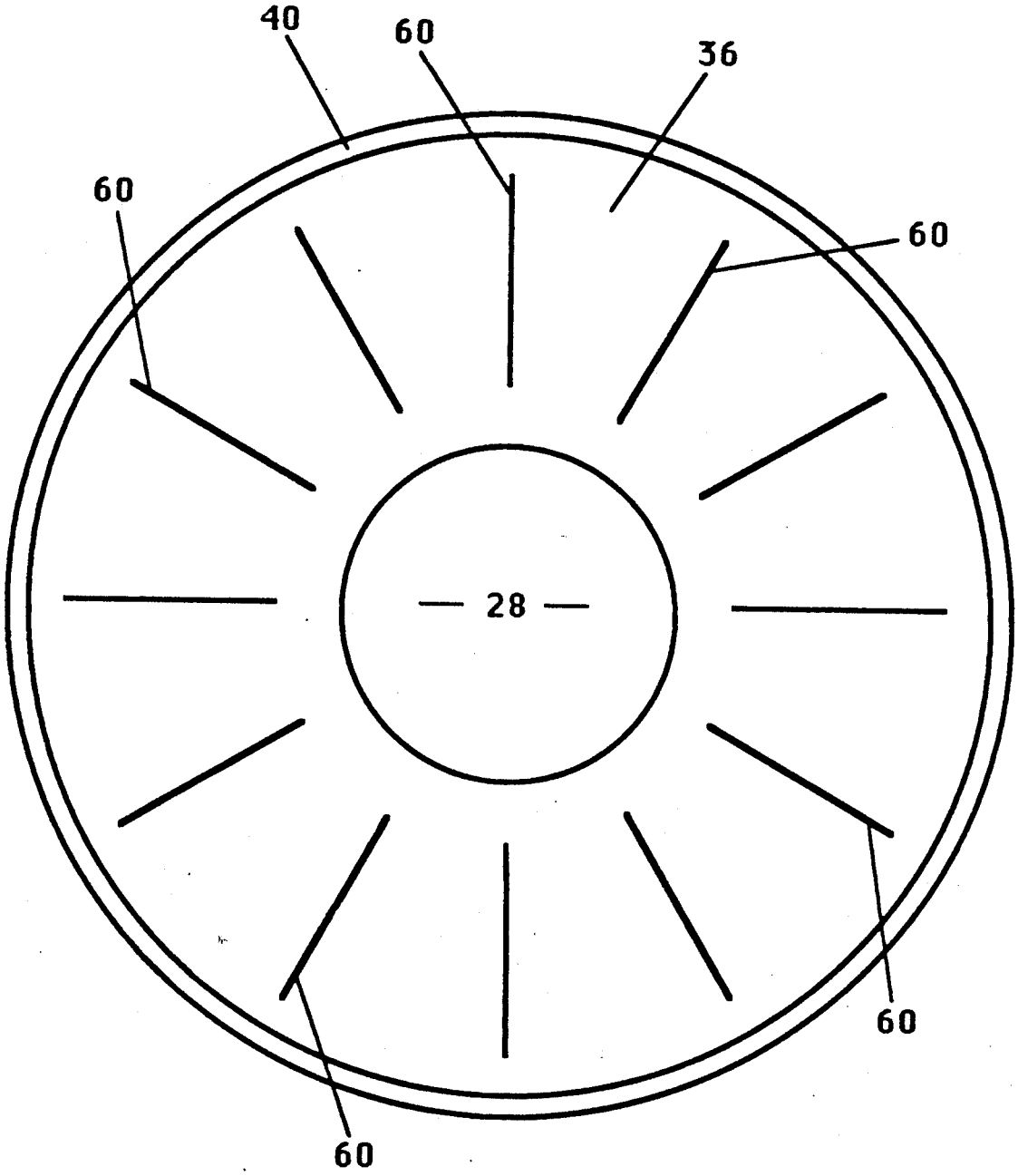
FIG. 3 is a top view of a portion of an embodiment of the present invention such as that of FIG. 1, illustrating the use of flow straighteners therein.

In the case of a water display generally in accordance with FIGS. 1 and 2 having a circular or circular arc shape, it has been found that under certain circumstances the relatively large change in radius of the water flow across surface 36 can result in eddies being formed in the flow areas which can detract from the uniformity of the hydraulic jumps and wave action created. To avoid this phenomenon, one can permanently position small radially oriented flow straighteners on surface 36, which straighteners may remain relatively non-intrusive to the casual observer yet effective in avoiding the problem. Such a circular array of flow straighteners 60 may be seen in FIG. 3, which is a top view of cap 28 and member 38 (FIGS. 1 and 2) showing the dam 40 and the surface 36 of member 38. Such flow straighteners have been found to eliminate this effect when only a reasonable number of straighteners are used, though of course in some instances the effect itself may be used for its own aesthetic purposes.

There has been described herein a new and unique water display which is simple in construction and control, readily adapted for installation in various sizes and geometry and which may provide an interesting and attention getting display in many environments. While certain preferred embodiments of the present invention have been disclosed and described herein, it will be understood by those skilled in the art that various changes in form and detail may be made therein without departing from the spirit and scope of the invention.

What is claimed is:

1. A water display comprising:

a source of water under pressure;

means defining a surface over which water is to flow;

means adjacent to said surface and coupled to said water under pressure for directing water from said source of water under pressure over said surface in a high velocity thin sheet of water, and;

means on said surface, to be intercepted by said thin sheet of water, for tending to establish a quantity of low velocity water of a thickness substantially greater than the thin sheet of water;

whereby a hydraulic jump is created in the boundary region between the high velocity thin sheet of water and the quantity of low velocity water of a thickness substantially greater than the thin sheet of water.

2. The water display of claim 1 wherein said means defining a surface over which water is to flow defines an approximately horizontal surface.

3. The water display of claim 1 wherein said means defining a surface over which water is to flow defines a surface sloping slightly downward from said means adjacent to said surface and coupled to said water under pressure for directing water from said source of water under pressure over said surface in a high velocity thin sheet of water.

4. The water display of claim 2 or 3 wherein said means for establishing on said surface a quantity of low velocity water of a thickness substantially greater than the thin sheet of water comprises a dam means on said surface.

5. The water display of claim 4 wherein said means defining a surface over which water is to flow is a means having first and second opposite sides, said means adjacent to said surface and coupled to said water under pressure for directing water from said source of water under pressure over said surface in a high velocity thin sheet of water being a means adjacent said first side for directing the water toward said second side, said dam means being adjacent said second side, whereby water passing over said dam means will free fall over said second side of said means defining a surface over which water is to flow.

6. The water display of claim 5 further including means for varying the pressure of the water under pressure.

7. The water display of claim 6 wherein said first and second opposite sides are substantially straight, parallel sides.

8. The water display of claim 6 wherein said first and second opposite sides are in the general shape of circular arcs having substantially common centers, said second side having a larger radius than said first side.

9. The water display of claim 8 wherein said first and second opposite sides are in the general shape of circular arcs substantially spanning a full 360 degrees.

10. The water display of claim 9 wherein said surface has a plurality of radially disposed flow guides thereon for maintaining the local flow thereby substantially radial in direction.

11. The water display of claim 1, 2 or 3 further including means for varying the pressure of the water under pressure.

12. A water display comprising:

a source of water under pressure;

means defining a surface over which water is to flow, said surface having first and second opposite sides, said surface sloping downward slightly from said first side to said second side;

means adjacent to said first side of said surface and coupled to said water under pressure for directing water from said source of water under pressure over said surface from said first side in a high velocity thin sheet of water, and;

dam means adjacent said second side of said surface, to be intercepted by said thin sheet of water, for tending to establish a quantity of low velocity water of a thickness substantially greater than the thin sheet of water;

whereby a hydraulic jump is created in the boundary region between the high velocity thin sheet of water and the quantity of low velocity water of a thickness substantially greater than the thin sheet of water and wherein water passing over said dam means will free fall over said second side of said means defining a surface over which water is to flow.

13. The water display of claim 12 further including means for varying the pressure of the water under pressure.

14. The water display of claim 13 wherein said first and second opposite sides are substantially straight, parallel sides.

15. The water display of claim 13 wherein said first and second opposite sides are in the general shape of circular arcs having substantially common centers, said second side having a larger radius than said first side.

16. The water display of claim 15 wherein said first and second opposite sides are in the general shape of circular arcs substantially spanning a full 360 degrees.

17. The water display of claim 16 wherein said surface has a plurality of radially disposed flow guides thereon for maintaining the local flow thereby substantially radial in direction.

18. A method of creating a water display comprising the steps of:

(a) providing a surface over which water is to flow having first and second opposite sides and sloping downward slightly from the first side to the second side, the surface having a shallow dam adjacent the second side thereof over which water may flow to free fall from the opposite side thereof;

(b) directing water from a source of water under pressure over the surface from the first side in a high velocity thin sheet of water, and;

(c) varying the pressure of the water under pressure;

whereby a hydraulic jump is created in the boundary region between the high velocity thin sheet of water and any quantity of low velocity water that tends to accumulate against the dam, the position of the hydraulic jump and the amount of water flowing over the dam varying in time responsive to the varying pressure of the water under pressure.

19. The method of claim 18 further comprised of the step of providing a pool below the dam into which water passing over the dam will flow.

* * * * *